US007851120B2

(12) United States Patent
Urabe et al.

(10) Patent No.: US 7,851,120 B2
(45) Date of Patent: Dec. 14, 2010

(54) DEVELOPING AGENT AND METHOD FOR PRODUCING THE SAME

(75) Inventors: Takashi Urabe, Suntou-gun (JP); Takayasu Aoki, Mishima (JP); Tsuyoshi Itou, Izunokuni (JP); Yasuhito Noda, Mishima (JP); Motonari Udo, Mishima (JP); Satoshi Araki, Izunokuni (JP); Masahiro Ikuta, Mishima (JP); Takafumi Hara, Mishima (JP); Asumi Matsumoto, Suntou-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 139 days.

(21) Appl. No.: 12/330,992

(22) Filed: Dec. 9, 2008

(65) Prior Publication Data

US 2009/0155708 A1 Jun. 18, 2009

Related U.S. Application Data

(60) Provisional application No. 61/013,468, filed on Dec. 13, 2007.

(51) Int. Cl.
*G03G 9/18* (2006.01)

(52) U.S. Cl. ..... 430/137.19; 430/137.1

(58) Field of Classification Search ..... 430/137.19, 430/137.1

See application file for complete search history.

(56) References Cited

U.S. PATENT DOCUMENTS

| | | | | |
|---|---|---|---|---|
| 7,507,517 | B2 * | 3/2009 | Wolfe et al. | 430/137.14 |
| 2007/0202433 | A1 * | 8/2007 | Matsumoto et al. | 430/137.19 |
| 2007/0281240 | A1 | 12/2007 | Urabe et al. | |
| 2008/0025754 | A1 * | 1/2008 | Ishiyama et al. | 399/106 |
| 2008/0138739 | A1 * | 6/2008 | Chung et al. | 430/137.14 |
| 2008/0171276 | A1 | 7/2008 | Urabe et al. | |
| 2008/0171282 | A1 | 7/2008 | Urabe et al. | |
| 2010/0209841 | A1 * | 8/2010 | Uchinokura et al. | 430/113 |

FOREIGN PATENT DOCUMENTS

| | | |
|---|---|---|
| JP | 63-282752 | 11/1988 |
| JP | 06-250439 | 9/1994 |
| JP | 09-311502 | 12/1997 |
| JP | 2007-052274 | 3/2007 |
| JP | 2007-187917 | 7/2007 |

* cited by examiner

*Primary Examiner*—Hoa V Le
(74) *Attorney, Agent, or Firm*—Turocy & Watson, LLP

(57) ABSTRACT

The dispersion liquid including toner material particles is introduced into a mechanical shearing device including a heating unit, a mechanical shearing unit, and a cooling unit, heated to a temperature not lower than the glass transition temperature of the polyester resin under a condition that satisfies the following relationship (1), subjected to mechanical shearing, and thereafter cooled, whereby fine particles are obtained.

$$-2<\log((A+B)/C)<2 \quad (1)$$

With the proviso that a volume of a portion in which the dispersion liquid flows in the heating unit and the mechanical shearing unit is expressed as A cc, a volume of a portion in which the dispersion liquid flows in the cooling unit is expressed as B cc, and a flow rate of the dispersion liquid is expressed as C cc/min.

17 Claims, 2 Drawing Sheets

DEVELOPING AGENT AND METHOD FOR PRODUCING THE SAME

CROSS-REFERENCE TO RELATED APPLICATIONS

This application is based upon and claims the benefit of priority from U.S. Provisional Application No. 61/013,468, filed Dec. 13, 2007, the entire contents of which are incorporated herein by reference.

TECHNICAL FIELD

The present invention relates to a method for producing a developing agent for developing an electrostatic image or a magnetic latent image in electrophotography, an electrostatic printing method, a magnetic recording method, and the like.

BACKGROUND

In electrophotography, an electrical latent image is formed on an image carrying member, then, the latent image is developed with a toner to form a toner image, and the toner image is transferred to a transfer material such as paper and then fixed by heating, applying pressure, or the like, whereby an image is formed. In order to form a full color image, not only a black toner, but also toners of a plurality of colors are used to form an image.

As the toner, a two-component developing agent to be used by mixing with carrier particles and a one-component developing agent to be used as a magnetic toner or a non-magnetic toner are known. As for a production method for these toners, these toners are generally produced by a kneading and pulverizing method. This kneading and pulverizing method is a method for producing desired toner particles by melt-kneading a binder resin, a pigment, a mold release agent such as a wax, a charge control agent, and the like, cooling the resulting mixture, followed by finely pulverizing the cooled mixture, and then classifying the finely pulverized particles. Inorganic and/or organic fine particles are added to the surface of toner particles produced by the kneading and pulverizing method in accordance with the intended use, and thus, the toner can be obtained.

In the case of toner particles produced by the kneading and pulverizing method, their shape is usually amorphous, and their surface composition is not uniform. Although the shape and the surface composition of toner particles are subtly changed depending on the pulverizability of the material to be used and conditions for the pulverization operation, it is difficult to intentionally control the shape.

Further, when a material with a particularly high pulverizability is used, the particles are more finely pulverized or their shape is changed due to various stresses in a developing machine. As a result, in a two-component developing agent, a problem sometimes arises that the finely pulverized toner is adhered to a carrier surface and accelerates deterioration of chargeability of the developing agent. Also, in a one-component developing agent, a problem sometimes arises that the particle size distribution is widened, the finely pulverized toner is scattered, or developability is reduced accompanied by a change in toner shape, and therefore, an image quality is deteriorated.

Further, when the toner contains a mold release agent such as a wax, the mold release agent is sometimes exposed to the surface of the toner because pulverization is likely to be caused at an interface between the binder resin and the mold release agent. In particular, when the toner is formed from a resin which has a high elasticity and is difficult to be pulverized and a brittle wax such as polyethylene, exposure of polyethylene to the surface of the toner is much seen. Although such a toner is advantageous in terms of a mold release property at fixing and cleaning of untransferred toner on a photoreceptor, the polyethylene on the surface of the toner is detached from the toner and can be easily transferred to a developing roll, an image carrying member, a carrier, or the like by a mechanical force such as a shearing force in the developing machine. Therefore, contamination of the developing roll, image carrying member, carrier, or the like with the wax is easily caused, and the reliability as a developing agent is lowered in some cases.

Under such circumstances, recently, as a method for producing a toner in which the shape and surface composition of toner particles are intentionally controlled, an emulsion polymerization agglomeration method is proposed in JP-A-63-282752 and JP-A-6-250439.

The emulsion polymerization agglomeration method is a method for obtaining toner particles by separately preparing a resin dispersion liquid by emulsion polymerization and a colorant dispersion liquid in which a colorant is dispersed in a solvent, mixing these dispersion liquids to form agglomerated particles with a size corresponding to a toner particle size, and fusing the particles by heating. According to this emulsion polymerization agglomeration method, the toner shape can be arbitrarily controlled from amorphous to spherical shape by the selection of a heating temperature condition.

In the emulsion polymerization agglomeration method, a toner can be obtained by agglomerating and fusing particles under a predetermined condition using at least a dispersion liquid of resin fine particles and a dispersion liquid of a colorant. However, the emulsion polymerization agglomeration method is limited as to the type of resin which can be synthesized, and the method cannot be applied to a polyester resin which is known to have a good fixability though the method is suitable for the production of a styrene-acrylic copolymer.

On the other hand, as a method for producing a toner using a polyester resin, a phase inversion emulsification method in which a pigment dispersion liquid and the like are added to a solution obtained by dissolving a polyester resin in an organic solvent and then water is added thereto is known, however, it is necessary to remove and recover the organic solvent. JP-A-9-311502 proposes a method for producing fine particles by mechanical shearing in an aqueous medium without using an organic solvent. However, it is necessary to feed a resin or the like in a molten state to a stirring device, and handling thereof is difficult. Further, with the use of this method, the degree of freedom for shape control is low, and the shape of toner could not be arbitrarily controlled from amorphous to spherical shape. Further, when a polyester resin is finely pulverized by mechanical shearing in an aqueous medium, hydrolysis thereof occurs, and the molecular weight of the polyester resin is decreased in some cases. A developing agent containing a polyester resin with a decreased molecular weight is likely to be agglomerated, and therefore, the storage stability is decreased. Further, a softening point of a polyester resin is changed accompanying a decrease in the molecular weight, and fixability is deteriorated.

SUMMARY

An object of the present invention is to provide a developing agent which can be reduced in the particle size and controlled as to the shape and has a good fixability and storage stability without using an organic solvent.

A method for producing a developing agent of the invention includes:

forming a dispersion liquid of a granulated mixture containing at least a polyester resin and a colorant by dispersing the granulated mixture in an aqueous medium;

introducing the dispersion liquid into a mechanical shearing device including a heating unit, a mechanical shearing unit, and a cooling unit;

heating the dispersion liquid to a temperature not lower than the glass transition temperature of the polyester resin through the heating unit;

finely granulating the granulated mixture by subjecting the heated dispersion liquid to mechanical shearing through the mechanical shearing unit; and obtaining fine particles by cooling the dispersion liquid to a temperature lower than the glass transition temperature of the polyester resin through the cooling unit.

In the method, when a volume of a portion in which the dispersion liquid flows in the heating unit and the mechanical shearing unit is expressed as A cc, a volume of a portion in which the dispersion liquid flows in the cooling unit is expressed as B cc, and a flow rate of the dispersion liquid is expressed as C cc/min, the following relationship (1) is satisfied.

$$-2<\log((A+B)/C)<2 \quad (1)$$

The developing agent of the invention is a developing agent containing fine particles obtained by dispersing a granulated mixture containing a binder resin and a colorant in an aqueous medium, introducing the resulting dispersion liquid into a mechanical shearing device including a heating unit, a mechanical shearing unit, and a cooling unit, heating the dispersion liquid to a temperature not lower than the glass transition temperature of the polyester resin, subjecting the dispersion liquid to mechanical shearing, and cooling the dispersion liquid.

In the developing agent, when a volume of a portion in which the dispersion liquid flows in the heating unit and the mechanical shearing unit is expressed as A cc, a volume of a portion in which the dispersion liquid flows in the cooling unit is expressed as B cc, and a flow rate of the dispersion liquid is expressed as C cc/min, the following relationship (1) is satisfied.

$$-2<\log((A+B)/C)<2 \quad (1)$$

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

Figure 1:
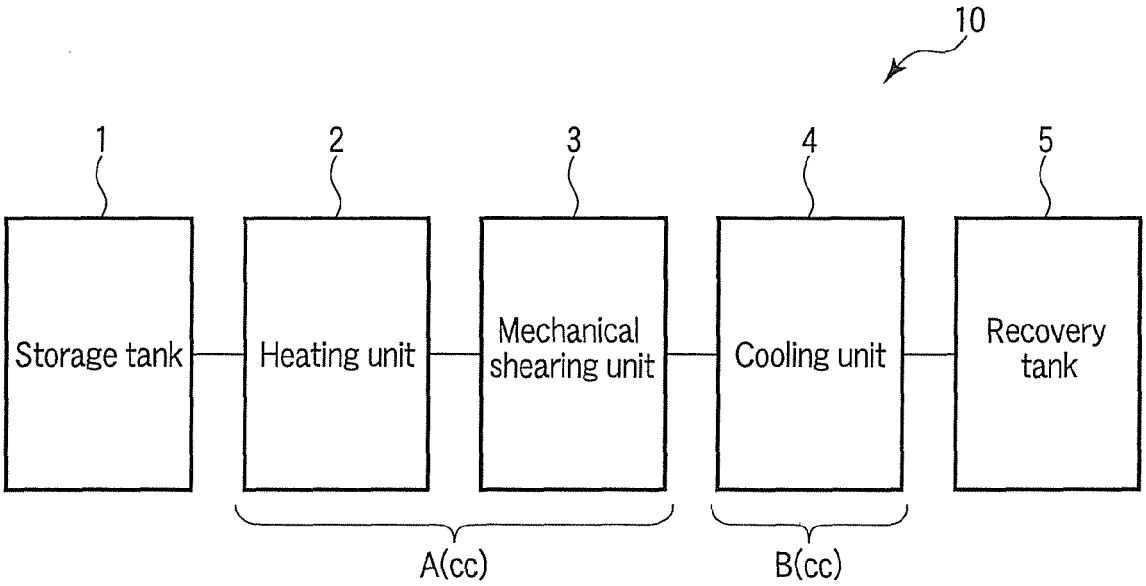
FIG. 1 is a block diagram for illustrating a mechanical shearing device applicable to the invention.

The present invention provides a method for producing a developing agent including:

forming a dispersion liquid of a granulated mixture containing at least a binder resin and a colorant by dispersing the granulated mixture in an aqueous medium; and obtaining fine particles by subjecting the dispersion liquid to mechanical shearing thereby finely granulating the granulated mixture.

As the binder resin, at least a polyester resin is used, and the mechanical shearing is carried out as follows.

First, the dispersion liquid is introduced into a mechanical shearing device including a heating unit, a mechanical shearing unit, and a cooling unit. Subsequently, the dispersion liquid is passed through the heating unit to heat the dispersion liquid to a temperature not lower than the glass transition temperature of the polyester resin. Subsequently, the heated dispersion liquid is passed through the mechanical shearing unit to more finely granulate the granulated mixture. Thereafter, the dispersion liquid is passed through the cooling unit to cool the dispersion liquid to a temperature lower than the glass transition temperature of the polyester resin. In this manner, fine particles are obtained.

Further, in the invention, when a volume of a flow path of the dispersion liquid in the heating unit and the mechanical shearing unit is expressed as A cc, a volume of a flow path of the dispersion liquid in the cooling unit is expressed as B cc, and a flow rate of the dispersion liquid is expressed as C cc/min, the following relationship (1) is satisfied.

$$-2<\log((A+B)/C)<2 \quad (1)$$

The phrase "a volume of a flow path" as used herein refers to a volume of a portion in which the dispersion liquid flows in the heating unit, mechanical shearing unit, and cooling unit.

Further, the developing agent according to the invention contains fine particles obtained by dispersing a granulated mixture containing a binder resin and a colorant in an aqueous medium, and subjecting the dispersion liquid to mechanical shearing as described below.

In the mechanical shearing, fine particles are obtained by introducing the dispersion liquid into a mechanical shearing device including a heating unit, a mechanical shearing unit, and a cooling unit, heating the dispersion liquid to a temperature not lower than the glass transition temperature of the polyester resin under a condition that satisfies the above-mentioned relationship (1), subjecting the dispersion liquid to mechanical shearing, followed by cooling.

In the above-mentioned relationship (1), the total of the volume A and the volume B is a volume of a region from where the dispersion liquid is heated to a temperature not lower than the glass transition temperature of the polyester resin to where the dispersion liquid is cooled to a temperature lower than the glass transition temperature of the polyester resin, which corresponds to a volume of a region in which the dispersion liquid having a temperature not lower than the glass transition temperature of the polyester resin is present if a region from where the dispersion liquid is heated to where the temperature of the dispersion liquid reaches the glass transition temperature of the polyester resin is excluded. A value obtained by dividing the total of the volume A and the volume B by the flow rate C cc/min results in a value approximate to a time for which the dispersion liquid having a temperature not lower than the glass transition temperature of the polyester resin flows in the mechanical shearing device.

According to the invention, by satisfying the relationship (1), the time for which the dispersion liquid is exposed to a temperature not lower than the glass transition temperature of the polyester resin is limited when fine particles are formed by finely pulverizing the granulated mixture in the dispersion liquid through mechanical shearing, whereby undesired hydrolysis of the polyester resin in fine particles can be prevented. Therefore, according to the invention, the particle size can be reduced and the shape of the particles can be controlled without using an organic solvent, and also by maintaining the molecular weight of the polyester resin, a developing agent can be obtained without deteriorating the fixability and storage stability.

It is more preferred that the values of the volume A, volume B, and flow rate C satisfy the following relationship (2).

$$-1<\log((A+B)/C)<1 \quad (2)$$

Hereinafter, the present invention will be described in further detail with reference to the drawings.

FIG. 1 is a block diagram for illustrating a mechanical shearing device applicable to the invention.

Figure 2:
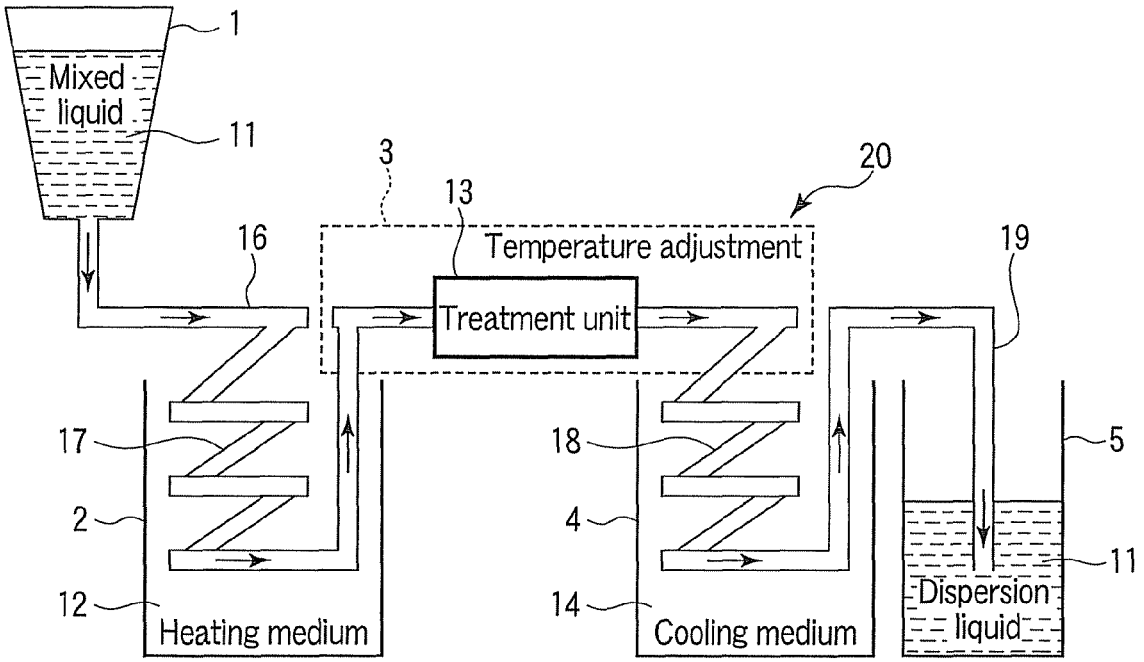
FIG. 2 is a schematic view showing an example of a configuration of a mechanical shearing device applicable to the invention.

FIG. 2 is a schematic view showing an example of a configuration of a mechanical shearing device applicable to the invention.

Figure 3:
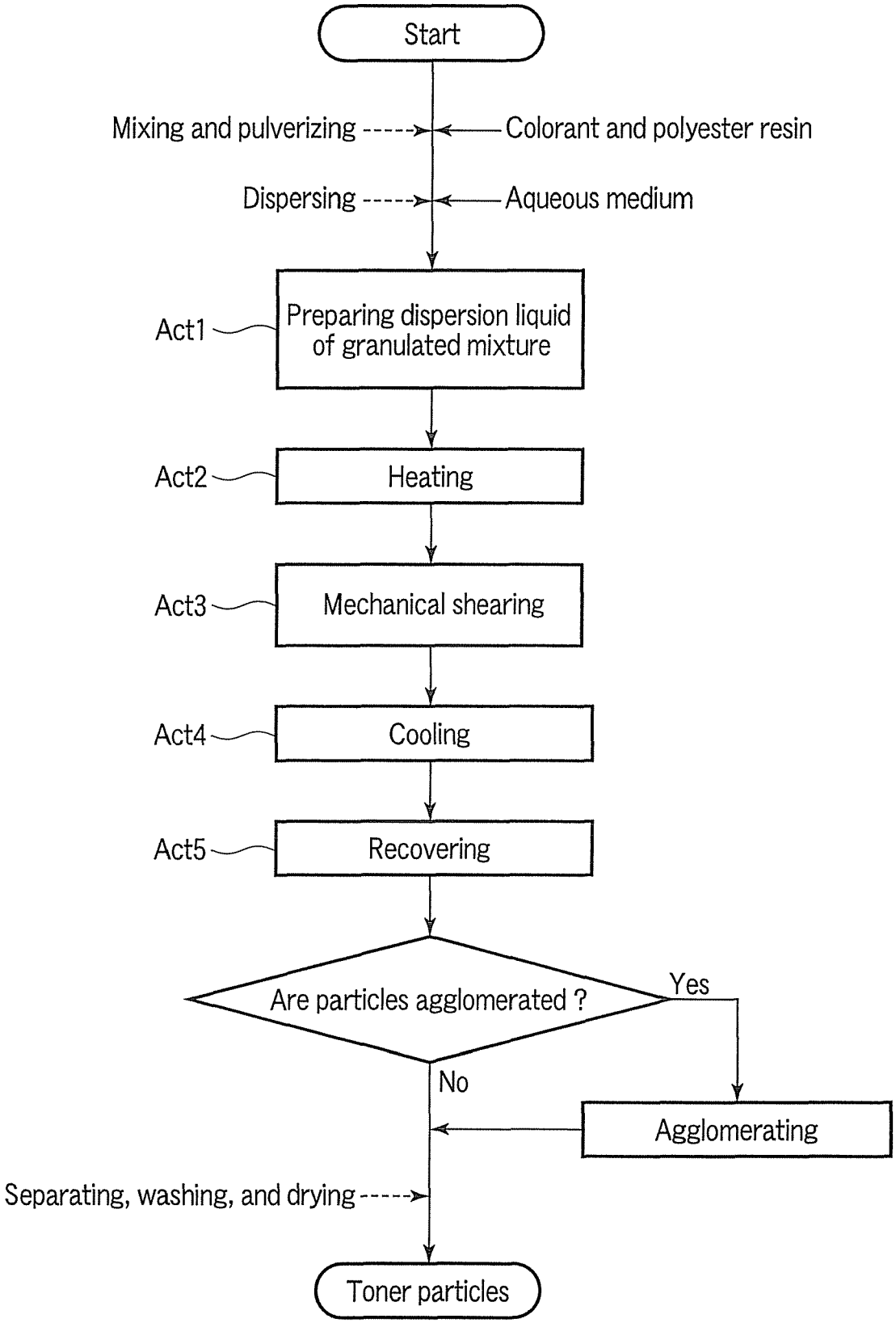
FIG. 3 is a flow diagram showing an example of a method for producing a developing agent of the invention.

FIG. 3 is a flow diagram showing an example of a method for producing a developing agent of the invention.

As shown in FIG. 1, a mechanical shearing device 10 applicable to the invention is a continuous pulverizing device provided with a storage tank 1 which stores a dispersion liquid, a heating unit 2 which heats the dispersion liquid discharged from the tank, a mechanical shearing unit 3 which performs mechanical shearing of the heated dispersion liquid, a cooling unit 4 for obtaining fine particles by cooling the more finely granulated mixture by mechanical shearing, and a recovery tank 5 which recovers the cooled dispersion liquid.

Further, as shown in FIG. 2, a mechanical shearing device 20 is an example of a device having a configuration shown in FIG. 1.

The storage tank 1 stores a dispersion liquid of a granulated mixture containing at least a polyester resin and a colorant obtained by dispersing the granulated mixture in an aqueous medium. The storage tank 1 is connected to the heating unit 2 through a conduit 16 and can discharge the dispersion liquid to the heating unit 2.

The heating unit 2 has a coiled nozzle 17 connected to the storage tank 1 through the conduit 16 and a member capable of immersing the nozzle 17, for example, an oil bath 12.

The heating unit 2 is connected to the mechanical shearing unit 3 having a treatment unit 13 which performs mechanical shearing.

In the mechanical shearing unit 3, as the treatment unit 13, for example, a high-pressure homogenizer using a nozzle having an orifice inner diameter of from 50 to 300 μm can be used. Mechanical shearing can be achieved by passing the dispersion liquid through this nozzle at a pressure of, for example, 80 MPa or more.

The cooling unit 4 has, for example, a coiled cooling nozzle 18 and a cooling medium such as cooling water which is allowed to flow around the cooling nozzle 18.

The cooling nozzle 18 in the cooling unit 4 is connected to a conduit 19. The conduit 19 extends into the recovery tank 5 which stores the dispersion liquid 11 recovered from the cooling unit 4 through the conduit 19.

By using the mechanical shearing device having such a configuration, toner particles to be used in a developing agent can be obtained.

In the method for producing a developing agent of the invention, first, coarsely granulated mixture containing at least a polyester resin and a colorant is prepared.

A granulated mixture is dispersed in an aqueous medium thereby preparing a dispersion liquid of the granulated mixture (Act 1).

The obtained dispersion liquid is fed to the storage tank 1.

The dispersion liquid is discharged from the storage tank 1, introduced into the heating unit 2, and heated to a temperature not lower than the glass transition temperature of the polyester resin (Act 2). In order to finely pulverize the mixture, it is necessary to raise the temperature of the dispersion liquid to a temperature not lower than the glass transition temperature of the polyester resin to be used. Further, it is advantageous that the temperature of the dispersion liquid is higher because the colored particles are finely pulverized. However, hydrolysis of the polyester resin is accelerated, therefore, there is a tendency that deterioration of fixability and the like are caused.

The heated dispersion liquid is passed through the mechanical shearing unit 3 and subjected to mechanical shearing in the treatment unit 13 thereby more finely granulating the granulated mixture (Act 3).

The dispersion liquid subjected to mechanical shearing is promptly sent to the cooling unit 4 and cooled to a temperature lower than the glass transition temperature of the polyester resin, whereby the finely granulated mixture is formed into stabilized fine particles (Act 4).

The cooled dispersion liquid is recovered in the recovery tank 5 through the conduit 19 (Act 5).

When the thus obtained fine particles are not agglomerated and used as such, the fine particles are separated from the cooled dispersion liquid, washed and dried, and thereafter, the resulting dried fine particles can be used as toner particles.

On the other hand, the thus obtained fine particles are agglomerated to a desired size, and the resulting agglomerated particles are washed and dried, and thereafter the resulting dried agglomerated particles can be used as toner particles.

The volume in the heating unit and the mechanical shearing unit (A cc), the volume in the cooling unit (B cc), and the flow rate of the dispersion liquid (C cc/min) are adjusted so as to satisfy the above-mentioned relationship (1).

The coarsely granulated mixture can be obtained by, for example, a process in which a mixture containing a binder resin and a colorant is melt-kneaded and then coarsely pulverized. Alternatively, it can be obtained by granulating a mixture containing a binder resin and a colorant.

The coarsely granulated mixture preferably has a volume average particle size of from 0.012 mm to 0.2 mm.

When the volume average particle size is less than 0.012 mm, an energy required for coarsely pulverizing the mixture becomes large, and the productivity is decreased. When it exceeds 0.2 mm, the interior of a pipe or the like installed in a pulverizing device is clogged with the coarsely granulated mixture, or a resulting particle size distribution is widened.

More preferably, the coarsely granulated mixture has a volume average particle size of from 0.015 mm to 0.1 mm.

The granulated mixture may further contain at least one of a wax and a charge control agent.

In the formation of the dispersion liquid of the coarsely granulated mixture, at least one of a surfactant and a pH adjusting agent can be arbitrarily added to the aqueous medium.

By the addition of a surfactant, the coarsely granulated mixture can be easily dispersed in the aqueous medium due to the action of the surfactant adsorbed onto the surface of the mixture. Further, by the addition of a pH adjusting agent, the degree of dissociation of a dissociable functional group on the surface of the mixture is increased or the polarity is increased, whereby the self-dispersibility can be improved.

The fine particles may have a volume average particle size of, for example, from 0.05 to 1.2 μm.

When the volume average particle size is less then 0.05 μm, the dispersion stability of the fine particles becomes high, and the fine particles are not agglomerated with one another during agglomeration and tend not to be incorporated in agglomerates. When the volume average particle size exceeds 1.2 μm, a particle size of toner particles obtained after agglomeration tends to become large.

When agglomerated particles are obtained, a plurality of fine particles can be agglomerated using at least one process of pH adjustment, addition of a surfactant, addition of a water-soluble metal salt, addition of an organic solvent, and temperature adjustment. By adjusting such a process, the shape of the resulting agglomerated particles can be controlled. Further, in order to stabilize the agglomerated particles, a dispersion liquid of the agglomerated particles can be heated, for example, to a temperature higher than the glass transition temperature of the binder resin by about 5° C. to 80° C.

When the temperature of the dispersion liquid is lower than a temperature which is higher than the glass transition temperature of the binder resin by 5° C., the binding strength between the agglomerated fine particles is low, and as a result, the mechanical strength of the resulting toner is decreased, and therefore, there is a tendency that toner particles are easily crushed in a developing machine. When the temperature of the dispersion liquid exceeds a temperature which is higher than the glass transition temperature of the binder resin by 80° C., there is a tendency that redispersion of the agglomerated particles is caused, or the resin is easily hydrolyzed due to long-term heating.

The agglomerated particles or the stabilized agglomerated particles preferably have a volume average particle size of from 1 to 10 μm.

The agglomerated particles or the stabilized agglomerated particles preferably have a circularity of from 0.8 to 1.0.

After the agglomerated particles are formed, the dispersion liquid of the agglomerated particles is cooled to, for example, 5° C. to a temperature not higher than the glass transition temperature. Thereafter, the agglomerated particles are washed using, for example, a filter press or the like, and then dried, whereby toner particles are obtained.

The toner particles preferably have a volume average particle size of from 3.0 to 7.0 μm.

As the binder resin to be used in the invention, a polyester resin is used.

Further, a polyester resin may be used singly or in combination with at least two or more members selected from styrene acryl resins and polyester/styrene acryl hybrid resins.

The polyester resin to be used preferably has an acid value of 1 or more.

Examples of the colorant to be used in the invention include carbon blacks, and organic or inorganic pigments or dyes. Examples of the carbon black include acetylene black, furnace black, thermal black, channel black, and Ketjen black. Further, examples of a yellow pigment include C.I. Pigment Yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183, and 185, and C.I. Vat Yellow 1, 3, and 20. These can be used alone or in admixture. Further, examples of a magenta pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, and 238, C.I. Pigment Violet 19, and C.I. Vat Red 1, 2, 10, 13, 15, 23, 29, and 35. These can be used alone or in admixture. Further, examples of a cyan pigment include C.I. Pigment Blue 2, 3, 15, 16, and 17, C.I. Vat Blue 6, and C.I. Acid Blue 45. These can be used alone or in admixture.

At least one of a wax and a charge control agent can be further added to the coarsely granulated mixture.

Examples of the wax include aliphatic hydrocarbon waxes such as low molecular weight polyethylene, low molecular weight polypropylene, polyolefin copolymers, polyolefin waxes, microcrystalline waxes, paraffin waxes, and Fischer-Tropsch waxes, oxides of an aliphatic hydrocarbon wax such as polyethylene oxide waxes or block copolymers thereof, vegetable waxes such as candelilla wax, carnauba wax, Japan wax, jojoba wax, and rice wax, animal waxes such as bees wax, lanolin, and whale wax, mineral waxes such as ozokerite, ceresin, and petrolatum, waxes containing, as the major component, a fatty acid ester such as montanic acid ester wax and castor wax, and deoxidation products resulting from deoxidization of a part or the whole of a fatty acid ester such as deoxidized carnauba wax. Further, saturated linear fatty acids such as palmitic acid, stearic acid, montanic acid, and long-chain alkyl carboxylic acids having a long-chain alkyl group, unsaturated fatty acids such as brassidic acid, eleostearic acid, and parinaric acid, saturated alcohols such as stearyl alcohol, eicosyl alcohol, behenyl alcohol, carnaubyl alcohol, ceryl alcohol, melissyl alcohol, and long-chain alkyl alcohols having a long-chain alkyl group, polyhydric alcohols such as sorbitol, fatty acid amides such as linoleic acid amide, oleic acid amide, and lauric acid amide, saturated fatty acid bisamides such as methylenebisstearic acid amide, ethylenebiscaprylic acid amide, ethylenebislauric acid amide, and hexamethylenebisstearic acid amide, unsaturated fatty acid amides such as ethylenebisoleic acid amide, hexamethylenebisoleic acid amide, N,N'-dioleyladipic acid amide, and N,N'-dioleylsebaccic acid amide, aromatic bisamides such as m-xylenebisstearic acid amide, and N,N'-distearylisophthalic acid amide, fatty acid metal salts (generally called metallic soaps) such as calcium stearate, calcium laurate, zinc stearate, and magnesium stearate, waxes obtained by grafting of a vinyl monomer such as styrene or acrylic acid on an aliphatic hydrocarbon wax, partially esterified products of a fatty acid and a polyhydric alcohol such as behenic acid monoglyceride, and methyl ester compounds having a hydroxyl group obtained by hydrogenation of a vegetable fat and oil can be exemplified.

Further, as the charge control agent for controlling a frictional charge quantity, for example, a metal-containing azo compound is used, and a complex or a complex salt in which the metal element is iron, cobalt, or chromium, or a mixture thereof is preferred. Other than these, a metal-containing salicylic acid derivative compound can also be used, and a complex or a complex salt in which the metal element is zirconium, zinc, chromium, or boron, or a mixture thereof is preferred.

The pH adjusting agent which can be used in the invention is not particularly limited, however, for example, an amine compound can be used other than sodium hydroxide, potassium hydroxide, or the like. Examples of the amine compound include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanolamine, N,N-dimethyl-1,3-diaminopropane, and N,N-diethyl-1,3-diaminopropane.

Examples of the surfactant which can be used in the invention include anionic surfactants such as sulfate-based, sulfonate-based, phosphate-based, and soap-based anionic surfactants, cationic surfactants such as amine salt-type and quaternary ammonium salt-type cationic surfactants, and nonionic surfactants such as polyethylene glycol-based, alkyl phenol ethylene oxide adduct-based, and polyhydric alcohol-based nonionic surfactants.

As the mechanical shearing device to be used in the invention, for example, a high-pressure device, a rotor-stator stirring device, or the like can be used. These devices can be used in combination with a heating device, a cooling device, and the like as needed.

With the high-pressure device, mechanical shearing at a pressure of, for example, 80 MPa or more can be carried out.

Further, the high-pressure device can include a nozzle having an orifice inner diameter of, for example, from 50 to 300 μm.

As the high-pressure device, for example, a high-pressure homogenizer can be used.

Examples of the high-pressure homogenizer which can be used in the invention include Manton-Gaulin High-Pressure Homogenizer (manufactured by Niro Soavi Inc.), Microfluidizer (manufactured by Mizuho Industry Co., Ltd.), Nanomizer (manufactured by Yoshida Kikai Co., Ltd.), Ultimizer (manufactured by Sugino Machine Limited), Genus PY (manufactured by Hakusui Chemical Industries Co., Ltd.), and NANO 3000 (manufactured by Beryu Co., Ltd.).

With the rotor-stator stirring device, mechanical shearing can be carried out by stirring at a peripheral speed of, for example, from 15 m/s to 45 m/s.

Examples of the rotor-stator stirring device include CLEAR MIX (manufactured by M TECHNIQUE Co., Ltd.), ULTRA TURRAX (manufactured by IKA Japan K.K.), and T.K. AUTO HOMO MIXER (manufactured by PRIMIX Corporation).

As the mechanical shearing device to be used in the invention, in addition to these, for example, medium-free mechanical shearing devices such as ULTRA TURRAX (manufactured by IKA Japan K.K.), T.K. AUTO HOMO MIXER (manufactured by PRIMIX Corporation), T.K. PIPELINE HOMO MIXER (manufactured by PRIMIX Corporation), T.K. FILMICS (manufactured by PRIMIX Corporation), CLEAR MIX (manufactured by M TECHNIQUE Co., Ltd.), CLEAR SS5 (manufactured by M TECHNIQUE Co., Ltd.), CAVITRON (manufactured by EUROTEC, Ltd.), FINE FLOW MILL (manufactured by Pacific Machinery & Engineering Co., Ltd.), Microfluidizer (manufactured by Mizuho Industry Co., Ltd.), Ultimizer (manufactured by Sugino Machine Limited), Nanomizer (manufactured by Yoshida Kikai Co. Ltd.), Genus PY (manufactured by Hakusui Chemical Industries Co., Ltd.), and NANO 3000 (manufactured by Beryu Co., Ltd.), and mechanical shearing devices using a medium such as VISCO MILL (manufactured by Aimex Co., Ltd.), APEX MILL (manufactured by Kotobuki Industries Co., Ltd.), STAR MILL (manufactured by Ashizawa Finetech Co., Ltd.), DCP SUPERFLOW (manufactured by Nippon Eirich Co., Ltd.), MP MILL (manufactured by Inoue Manufacturing Co., Ltd.), SPIKE MILL (manufactured by Inoue Manufacturing Co., Ltd.), MIGHTY MILL (manufactured by Inoue Manufacturing Co., Ltd.), and SC MILL (manufactured by Mitsui Mining Co., Ltd.), and the like can be exemplified.

In the invention, a mixed material or a kneaded material containing at least a resin and a pigment is finely granulated while heating by using a mechanical shearing device, and the material thus finely granulated is cooled to a temperature not higher than the glass transition temperature. However, the material may be cooled to a desired temperature at which agglomeration is carried out.

In the invention, in order to prepare a coarsely granulated mixture, a mixture containing at least a binder resin and a colorant can be kneaded.

A kneader to be used is not particularly limited as long as it can perform melt-kneading, however, examples thereof include a single screw extruder, a twin screw extruder, a pressure kneader, a Banbury mixer, and a Brabender mixer. Specific examples thereof include FCM (manufactured by Kobe Steel, Ltd.), NCM (manufactured by Kobe Steel, Ltd.), LCM (manufactured by Kobe Steel, Ltd.), ACM (manufactured by Kobe Steel, Ltd.), KTX (manufactured by Kobe Steel, Ltd.), GT (manufactured by Ikegai, Ltd.), PCM (manufactured by Ikegai, Ltd.), TEX (manufactured by the Japan Steel Works, Ltd.), TEM (manufactured by Toshiba Machine Co., Ltd.), ZSK (manufactured by Warner K.K.), and KNEADEX (manufactured by Mitsui Mining Co., Ltd.).

In the invention, when the fine particles are agglomerated, a water-soluble metal salt can be used. Examples of the water-soluble metal salt include metal salts such as sodium chloride, calcium chloride, calcium nitrate, barium chloride, magnesium chloride, zinc chloride, magnesium sulfate, aluminum chloride, and aluminum sulfate, and inorganic metal salt polymers such as poly(aluminum chloride), poly(aluminum hydroxide), and calcium polysulfide.

In the invention, when the fine particles are agglomerated, an organic solvent may be used. Examples of the organic solvent include alcohols such as methanol, ethanol, 1-propanol, 2-propanol, 2-methyl-2-propanol, 2-methoxyethanol, 2-ethoxyethanol, and 2-butoxyethanol, acetonitrile, and 1,4-dioxane.

In the invention, in order to adjust the fluidity or chargeability of the toner particles, inorganic fine particles may be added and mixed in the surface of the toner particles in an amount of from 0.01 to 20% by weight based on the total weight of the toner. As such inorganic fine particles, silica, titania, alumina, strontium titanate, tin oxide, and the like can be used alone or in admixture of two or more kinds thereof.

It is preferred that as the inorganic fine particles, inorganic fine particles surface-treated with a hydrophobizing agent are used from the viewpoint of improvement of environmental stability. Further, other than such inorganic oxides, resin fine particles having a particle size of 1 μm or less may be externally added for improving the cleaning property.

Examples of a mixing machine for inorganic fine particles and the like include Henschel mixer (manufactured by Mitsui Mining Co., Ltd.), Super mixer (manufactured by Kawata Mfg. Co., Ltd.), Libocone (manufactured by Okawara Mfg. Co., Ltd.), Nauta mixer (manufactured by Hosokawa Micron, Co., Ltd.), Turbulizer (manufactured by Hosokawa Micron, Co., Ltd.), Cyclomixer (manufactured by Hosokawa Micron, Co., Ltd.), Spiral Pin Mixer (manufactured by Pacific Machinery & Engineering Co., Ltd.), and Lodige Mixer (manufactured by Matsubo Corporation).

In the invention, further, coarse particles and the like may be sieved. Examples of a sieving device which is used for sieving include ULTRA SONIC (manufactured by Koei Sangyo Co., Ltd.), Gyro shifter (manufactured by Tokuju Corporation), VIBRASONIC SYSTEM (manufactured by Dalton Co., Ltd.), SONICLEAN (manufactured by Shinto Kogyo K.K.), TURBO SCREENER (manufactured by Turbo Kogyo Co., Ltd.), MICRO SHIFTER (manufactured by Makino Mfg. Co., Ltd.), and a circular vibrating sieve.

EXAMPLES

Example 1

90 parts by weight of a polyester resin (glass transition temperature: 58° C., acid value: 6, weight average molecular weight Mw: 13,658) as a binder resin, 5 parts by weight of a cyan pigment as a colorant, 4 parts by weight of an ester wax, and 1 part by weight of a zirconia metal complex as a charge control agent were mixed, and the resulting mixture was melt-kneaded using a twin screw kneader whose temperature was set to 120° C., whereby a kneaded material was obtained.

The thus obtained kneaded material was coarsely pulverized to a volume average particle size of 1.2 mm using a hammer mill manufactured by Nara Machinery Co., Ltd., whereby coarse particles were obtained. Subsequently, the thus obtained coarse particles were further pulverized using a pulverizer manufactured by Hosokawa Micron Corporation, whereby moderately pulverized particles having a volume average particle size of 58 μm were obtained.

30 parts by weight of the thus obtained moderately pulverized particles, 1 part by weight of sodium dodecylbenzene sulfonate as an anionic surfactant, 1 part by weight of triethylamine as an amine compound and 68 parts by weight of ion exchanged water were stirred using a homogenizer manufactured by IKA Japan K.K., whereby a dispersion liquid 1 was obtained.

Subsequently, the thus obtained dispersion liquid 1 was fed to a nanomizer, YSNM-2000AR, manufactured by Yoshida Kikai Co., Ltd. provided with a heating system, whereby colored fine particles were obtained. The nanomizer is provided with an oil bath and a heating coil having an inner diameter of ⅜ inch, i.e., 3.2 mm, a length of 10 m, and a volume of 79 cc immersed in the oil bath, and the dispersion liquid is heated to a temperature not lower than the glass transition temperature in this portion. Further, the treatment unit is provided with a generator with a size of 100 μm, and a cooling coil having a length of 10 m and a volume of 79 cc is installed right behind the generator. By allowing cooling water to flow around the cooling coil, the dispersion liquid can be cooled to a temperature lower than the glass transition temperature. Since the generator portion has a volume of 0.1 cc or less, the volume of the mixed liquid or dispersion liquid which is heated to a temperature not lower than the glass transition temperature can be substantially expressed as the sum of the volume of the heating coil and the volume of the cooling coil.

At this time, the heating system temperature, i.e., the oil bath temperature was set to 200° C., and a treatment was performed only once at a treatment pressure of 80 MPa. Further, the flow rate of the dispersion liquid was measured based on the discharged amount and found to be 100 cc/min. The volume average particle size of the colored fine particles obtained after cooling was measured using a laser diffraction particle size analyzer, SALD-7000, manufactured by Shimadzu Corporation and found to be 0.652 μm. The volume average particle size of the colored fine particles is preferably 1.2 μm or less. When it is more than 1.2 μm, there is a tendency that the volume average particle size of toner particles obtained after agglomeration becomes large, or a particle size distribution becomes wide.

To the thus obtained fine particle dispersion liquid, 40 parts by weight of a 5% aqueous solution of magnesium sulfate was added, and the temperature of the mixture was gradually raised to 70° C. to agglomerate the fine particles to a desired volume average particle size, whereby agglomerated particles were obtained. For maintaining the volume average particle size of the colored particles, 2 parts by weight of sodium dodecylbenzene sulfonate was added thereto as a dispersing agent, and for controlling the shape of the agglomerated particles, the temperature of the mixture was raised to 90° C., and the mixture was left as such for 3 hours.

After cooling the mixture, the thus obtained agglomerated particles were washed using a centrifuge until the electrical conductivity of the washing water after washing became 50 μS/cm. Thereafter, the resulting agglomerated particles were dried using a vacuum dryer until the water content became 0.3% by weight, whereby toner particles having a volume average particle size of 4.5 μm were obtained.

The weight average molecular weight of the thus obtained toner was measured using Alliance 2695 (manufactured by Waters Corporation) and found to be 13554. A percentage of a change in the molecular weight was calculated based on the following expression and found to be −0.76%.

$$\{(\text{molecular weight of toner})-(\text{molecular weight of resin before treatment})\}/(\text{molecular weight of resin before treatment})\times 100$$

A percentage of a change in the weight average molecular weight is preferably −5% or less. When it is more than −5%, deterioration of storage stability or fixability of toner or the like is caused due to a low-molecular weight compound formed by hydrolysis and the performance of toner is decreased.

The storage stability was tested as follows. 20 g of a toner sample was left in an environment at a temperature of 55° C. for 8 hours, and thereafter, slowly placed on 42 mesh (opening of 350 μm). Then, the mesh was shaken for 10 sec using a powder tester (manufactured by Hosokawa Micron, Co., Ltd.), and the amount of toner remaining on the mesh was determined to be a storage stability value. When a toner shows a storage stability value of 0.5 g or less, the toner is not solidified in the marketplace. However, when a toner shows a storage stability value of not less than 0.5 g, a part of solidified toner may cause an image defect. A storage stability value of the toner obtained in Example 1 was 0.2 g.

The toner was placed in a multifunction machine e-STUDIO 281c manufactured by Toshiba Tec Corporation modified for evaluation of electrophotographic toner and a temperature of a fixing device was changed on purpose to evaluate a fixing device temperature at which a good image was obtained. As a result, the fixing device temperature at which a good image was obtained was found to be from 150° C. to 190° C., and a non-offset temperature range was 40° C. When a non-offset temperature range was 20° C. or lower, due to a fixing device temperature variation which occurs when paper is continuously fed, a poorly fixed image is formed.

Example 2

Colored fine particles having a volume average particle size of 0.491 μm were obtained under the same condition as in Example 1 except that the treatment pressure of the nanomizer was changed to 200 MPa. A flow rate at this time was 250 cc/min. A toner was prepared under the same condition as in Example 1, and as a result, a toner having a volume average particle size of 4.0 μm was obtained. A weight average molecular weight of the thus obtained toner was measured and found to be 13,587, and a percentage of a change in the molecular weight was −0.52%. A storage stability value of the toner was 0.2 g, and a non-offset temperature range was 40° C., i.e., fixing could be achieved at 150° C. to 190° C.

Example 3

Colored fine particles having a volume average particle size of 0.423 μm were obtained under the same condition as in Example 2 except that the length of the heating coil of the nanomizer was changed from 10 m to 20 m. A flow rate at this time was 250 cc/min. A toner was prepared in the same manner as in Example 1, and as a result, a toner having a volume average particle size of 3.8 μm was obtained. A weight average molecular weight of the thus obtained toner was measured and found to be 13,476, and a percentage of a change in the molecular weight was −1.33%. A storage stability value of the toner was 0.4 g, and a non-offset temperature range was 40° C., i.e., fixing could be achieved at 150° C. to 190° C.

Example 4

A mixed liquid 1 was prepared in the same manner as in Example 1.

Subsequently, the obtained mixed liquid 1 was fed to CLEAR MIX 2.2S (manufactured by M TECHNIQUE Co., Ltd.), and colored fine particles were obtained. The CLEAR MIX has a 79 cc heating coil and a 79 cc cooling coil in the same manner as in Example 1, and a 1000 cc vessel is installed in a treatment unit. In this vessel, a high-speed rotating stirring blade is installed and moderately pulverized particles are finely pulverized through mechanical shearing. Further, the vessel is heated to 130° C., and a volume of a portion having a temperature not lower than the Tg is 1,158 cc in total. In addition, a valve is installed in an ejection section of the 1000 cc vessel, and a flow rate can be adjusted by opening and closing of the valve. Further, a liquid feed pump is installed between the tank and the CLEAR MIX.

The revolutions per minute of the CLEAR MIX 2.2S was set to 18,000 rpm, and a treatment was performed by adjusting an opening degree of the valve such that the flow rate was 100 cc/min. A volume average particle size of the obtained colored fine particles was 0.591 μm.

A toner was prepared under the same condition as in Example 1, and as a result, a toner having a volume average particle size of 4.3 μm was obtained. A weight average molecular weight of the thus obtained toner was measured and found to be 13,267, and a percentage of a change in the molecular weight was −2.86%. A storage stability value of the toner was 0.4 g, and a non-offset temperature range was 35° C., i.e., fixing could be achieved at 150° C. to 185° C.

Example 5

Colored fine particles having a volume average particle size of 0.362 μm were obtained under the same condition as in Example 4 except that the flow rate was changed to 15 cc/min by adjusting an opening degree of the valve. A toner was prepared under the same condition as in Example 1, and as a result, a toner having a volume average particle size of 3.7 μm was obtained. A weight average molecular weight of the thus obtained toner was measured and found to be 13,002, and a percentage of a change in the molecular weight was −4.8%. A storage stability value of the toner was 0.5 g, and a non-offset temperature range was 30° C., i.e., fixing could be achieved at 140° C. to 170° C.

Example 6

Colored fine particles having a volume average particle size of 0.782 μm were obtained under the same condition as in Example 4 except that the flow rate was changed to 400 cc/min by adjusting an opening degree of the valve. A toner was prepared under the same condition as in Example 1, and as a result, a toner having a volume average particle size of 6.2 μm was obtained. A weight average molecular weight of the thus obtained toner was measured and found to be 13,472, and a percentage of a change in the molecular weight was −1.36%. A storage stability value of the toner was 0.4 g, and a non-offset temperature range was 40° C., i.e., fixing could be achieved at 150° C. to 190° C.

Comparative Example 1

Colored particles having a volume average particle size of 57 μm were obtained under the same condition as in Example 1 except that the generator installed in the treatment unit was detached. Because the generator was detached from the unit, a flow rate was increased to 20,000 cc/min, but pulverization could not be performed.

Comparative Example 2

Colored fine particles having a volume average particle size of 0.358 μm were obtained under the same condition as in Example 4 except that the flow rate was changed to 12 cc/min by adjusting an opening degree of the valve. A toner was prepared under the same condition as in Example 1, and as a result, a toner having a volume average particle size of 3.7 μm was obtained. A weight average molecular weight of the thus obtained toner was measured and found to be 12,767, and a percentage of a change in the molecular weight was −6.52%. A storage stability value of the toner was 1.5 g, and a non-offset temperature range was 20° C., i.e., fixing could be achieved at 140° C. to 160° C.

The evaluation results for the developing agents of the above-mentioned Examples 1 to 6 and Comparative examples 1 and 2 are shown in the following table.

TABLE

| | Treatment condition | | | | | Evaluation item | | | |
|---|---|---|---|---|---|---|---|---|---|
| | Configuration of device of treatment unit | A (cc) | B (cc) | C (cc/min) | log ((A + B)/C) | Volume average particle size of colored fine particles (μm) | Percentage of change in molecular weight (%) | Storage Stability (at 55° C.) | Non-offset temperature range |
| Example 1 | High-pressure type | 79 | 79 | 100 | 0.2 | 0.652 | −0.76 | 0.2 | 40 |
| Example 2 | High-pressure type | 79 | 79 | 250 | −0.2 | 0.491 | −0.52 | 0.2 | 40 |
| Example 3 | High-pressure type | 158 | 79 | 250 | 0.0 | 0.423 | −1.33 | 0.4 | 40 |
| Example 4 | Rotor-stator type | 1079 | 79 | 100 | 1.1 | 0.591 | −2.86 | 0.4 | 35 |
| Example 5 | Rotor-stator type | 1079 | 79 | 15 | 1.9 | 0.362 | −4.8 | 0.5 | 30 |
| Example 6 | Rotor-stator type | 1079 | 79 | 400 | 0.5 | 0.782 | −1.36 | 0.4 | 40 |
| Comparative example 1 | High-pressure type | 79 | 79 | 20,000 | −2.1 | 57 | 0 | — | — |
| Comparative example 2 | Rotor-stator type | 1079 | 79 | 12 | 2.0 | 0.358 | −6.52 | 1.5 | 20 |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for producing a developing agent comprising:

forming a dispersion liquid of mixture particles containing at least a mixture of a polyester resin and a colorant by dispersing the mixture particles in an aqueous medium;

introducing the dispersion liquid into a mechanical shearing device including a heating unit, a mechanical shearing unit, and a cooling unit;

heating the dispersion liquid to a temperature not lower than the glass transition temperature of the polyester resin through the heating unit;

granulating the mixture particles by subjecting the heated dispersion liquid to mechanical shearing through the mechanical shearing unit; and obtaining fine particles by cooling the dispersion liquid to a temperature lower than the glass transition temperature of the polyester resin through the cooling unit, wherein when a volume of a portion in which the dispersion liquid flows in the heating unit and the mechanical shearing unit is expressed as A cc; a volume of a portion in which the dispersion liquid flows in the cooling unit is expressed as B cc; and a flow rate of the dispersion liquid is expressed as C cc/min, the following relationship (1) is satisfied:

$$-2<\log((A+B)/C)<2 \quad (1).$$

2. The method according to claim 1, wherein the values of the volume A, the volume B, and the flow rate C further satisfy the following relationship (2):

$$-1<\log((A+B)/C)<1 \quad (2).$$

3. The method according to claim 1, wherein the mechanical shearing device includes a high-pressure device capable of performing mechanical shearing at a pressure of 80 MPa or more.

4. The method according to claim 3, wherein the mechanical shearing unit of the high-pressure device includes a nozzle having an orifice inner diameter of from 50 to 300 μm.

5. The method according to claim 1, wherein the mechanical shearing device includes a rotor-stator stirring device capable of performing mechanical shearing by stirring at a peripheral speed of from 15 m/s to 45 m/s.

6. The method according to claim 1, wherein the mixture is particles obtained by melt-kneading a mixture containing the binder resin and the colorant and pulverizing the melt-kneaded mixture.

7. The method according to claim 1, wherein the mixture particles comprises particles having a volume average particle size of from 12 to 200 μm.

8. The method according to claim 1, wherein in the formation of the dispersion liquid of the mixture particles, at least one of a surfactant and a pH adjusting agent is added to the aqueous medium.

9. The method according to claim 8, wherein the pH adjusting agent is selected from the group consisting of an organic amine compound, sodium hydroxide, and potassium hydroxide.

10. The method according to claim 8, wherein the surfactant is an anionic surfactant.

11. The method according to claim 1, wherein the fine particles have a volume average particle size of from 0.05 to 1.2 μm.

12. The method according to claim 1, wherein the mixture particles further contains at least one of a wax and a charge control agent.

13. The method according to claim 1, wherein the polyester resin has an acid value of 1 or more.

14. The method according to claim 1, further comprising forming agglomerated particles having a second particle size larger than the first particle size by agglomerating the fine particles.

15. The method according to claim 14, wherein the agglomerated particles have a volume average particle size of from 1 to 10 μm.

16. The method according to claim 14, wherein the agglomerated particles have a circularity of from 0.8 to 1.0.

17. The method according to claim 14, wherein in the formation of the agglomerated particles, a plurality of the fine particles are agglomerated using at least one process of pH adjustment, addition of a surfactant, addition of a water-soluble metal salt, addition of an organic solvent, and temperature adjustment.

* * * * *